US011687021B2

(12) United States Patent
Watanabe

(10) Patent No.: US 11,687,021 B2
(45) Date of Patent: Jun. 27, 2023

(54) SHEET DISCHARGE DEVICE, IMAGE FORMING DEVICE, AND SHEET DISCHARGE METHOD

(71) Applicant: FUJIFILM Business Innovation Corp., Tokyo (JP)

(72) Inventor: Taiki Watanabe, Yokohama (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/460,794

(22) Filed: Aug. 30, 2021

(65) Prior Publication Data

US 2022/0373952 A1 Nov. 24, 2022

(30) Foreign Application Priority Data

May 20, 2021 (JP) ..... JP2021-085629
May 20, 2021 (JP) ..... JP2021-085630

(51) Int. Cl.
*G03G 15/00* (2006.01)
*B65H 31/34* (2006.01)

(52) U.S. Cl.
CPC ..... *G03G 15/5029* (2013.01); *B65H 31/34* (2013.01); *G03G 15/6552* (2013.01)

(58) Field of Classification Search
CPC . G03G 15/5029; G03G 15/6552; B65H 31/34
See application file for complete search history.

(56) References Cited

U.S. PATENT DOCUMENTS

2008/0308991 A1* 12/2008 Sasahara ..... G03G 21/206 270/58.08
2017/0036880 A1* 2/2017 Tokuma ..... B65H 43/00
2017/0233214 A1* 8/2017 Kim ..... B65H 33/08 270/1.01

FOREIGN PATENT DOCUMENTS

JP 2002-226133 A 8/2002

* cited by examiner

*Primary Examiner* — Susan S Lee
(74) *Attorney, Agent, or Firm* — Oliff PLC

(57) ABSTRACT

A sheet discharge device includes: at least one processor; a conveyance unit configured to convey a sheet along a conveyance path; a discharge unit to which the sheet is discharged; a storage unit that is provided in a middle of the conveyance path and temporarily stores the sheet; an alignment unit provided in the discharge unit and configured to align the sheet in a width direction intersecting a convey direction of the sheet, in which the processor is configured to change a method of aligning the sheets by the alignment unit between a case where storage control for storing the sheets in the storage unit is performed and a case where the storage control is not performed.

20 Claims, 13 Drawing Sheets

SHEET DISCHARGE DEVICE, IMAGE FORMING DEVICE, AND SHEET DISCHARGE METHOD

CROSS-REFERENCE TO RELATED APPLICATIONS

This application is based on and claims priority under 35 USC 119 from Japanese Patent Application No. 2021-085629 filed on May 20, 2021 and Japanese Patent Application No. 2021-085630 filed on May 20, 2021.

BACKGROUND

Technical Field

The present invention related to a sheet discharge device, an image forming device, and a sheet discharge method.

Related Art

JP-A-2002-226133 listed below discloses, a discharge unit configured to discharge a conveyed sheet medium, a stacking unit configured to stack the sheet medium discharged by the discharge unit, an aligning unit for aligning the sheet media stacked on the stacking means in a manner of sandwiching an end face of the sheet media parallel to a discharge direction of the sheet media by the discharge unit, a sorting unit configured to sort the sheet medium by moving the stacking unit or the alignment unit by a predetermined amount in a shift direction orthogonal to a sheet medium discharge direction of the discharge unit, a returning unit comprising a rotating body that aligns a sheet medium by abutting the sheet medium against a standing wall provided at an alignment position, in which plural detecting units for detecting an upper surface position of the stacking unit are provided corresponding to plural different positions on an upper surface of the stacking unit, respectively.

SUMMARY

For example, in a configuration in which an alignment unit for aligning sheets is provided in a discharge unit to which sheets are discharged, when sheets discharged one by one to the discharge unit are aligned by the alignment unit, an operation time of the alignment unit needs to be shorter than a conveyance interval of sheets sequentially conveyed.

One aspect of non-limiting embodiments of the present disclosure relate to obtaining a sheet discharge device, an image forming device and a sheet discharge method in which sheets are aligned while inhibiting a decrease in productivity of sheets, as compared with a case where the sheet alignment method is always the same regardless of whether sheet storage control is performed by a storage unit. Another aspect of non-limiting embodiments of the present disclosure relate to obtaining a sheet discharge device, an image forming device and a sheet discharge method in which sheets are processed while inhibiting a decrease in productivity of sheets as compared with a case where sheets are discharged one by one and processed one by one.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a sheet discharge device including: at least one processor; a conveyance unit configured to convey a sheet along a conveyance path; a discharge unit to which the sheet is discharged; a storage unit that is provided in a middle of the conveyance path and temporarily stores the sheet; an alignment unit provided in the discharge unit and configured to align the sheet in a width direction intersecting a convey direction of the sheet, in which the processor is configured to change a method of aligning the sheets by the alignment unit between a case where storage control for storing the sheets in the storage unit is performed and a case where the storage control is not performed.

BRIEF DESCRIPTION OF DRAWINGS

Exemplary embodiment(s) of the present invention will be described in detail based on the following figures, wherein.

DETAILED DESCRIPTION

An example of a sheet discharge device and an image forming device according to an exemplary embodiment of the present invention will be described. In the following description, in each drawing, a direction (X direction) indicated by an arrow X is referred to as an device width direction, and a direction (Z direction) indicated by an arrow Z is referred to as an device height direction. In each drawing, a direction (Y direction) orthogonal to each of the X direction and the Z direction is indicated by an arrow Y as a device depth direction.

First Exemplary Embodiment

<Overall Configuration of Image Forming System>

Figure 1:
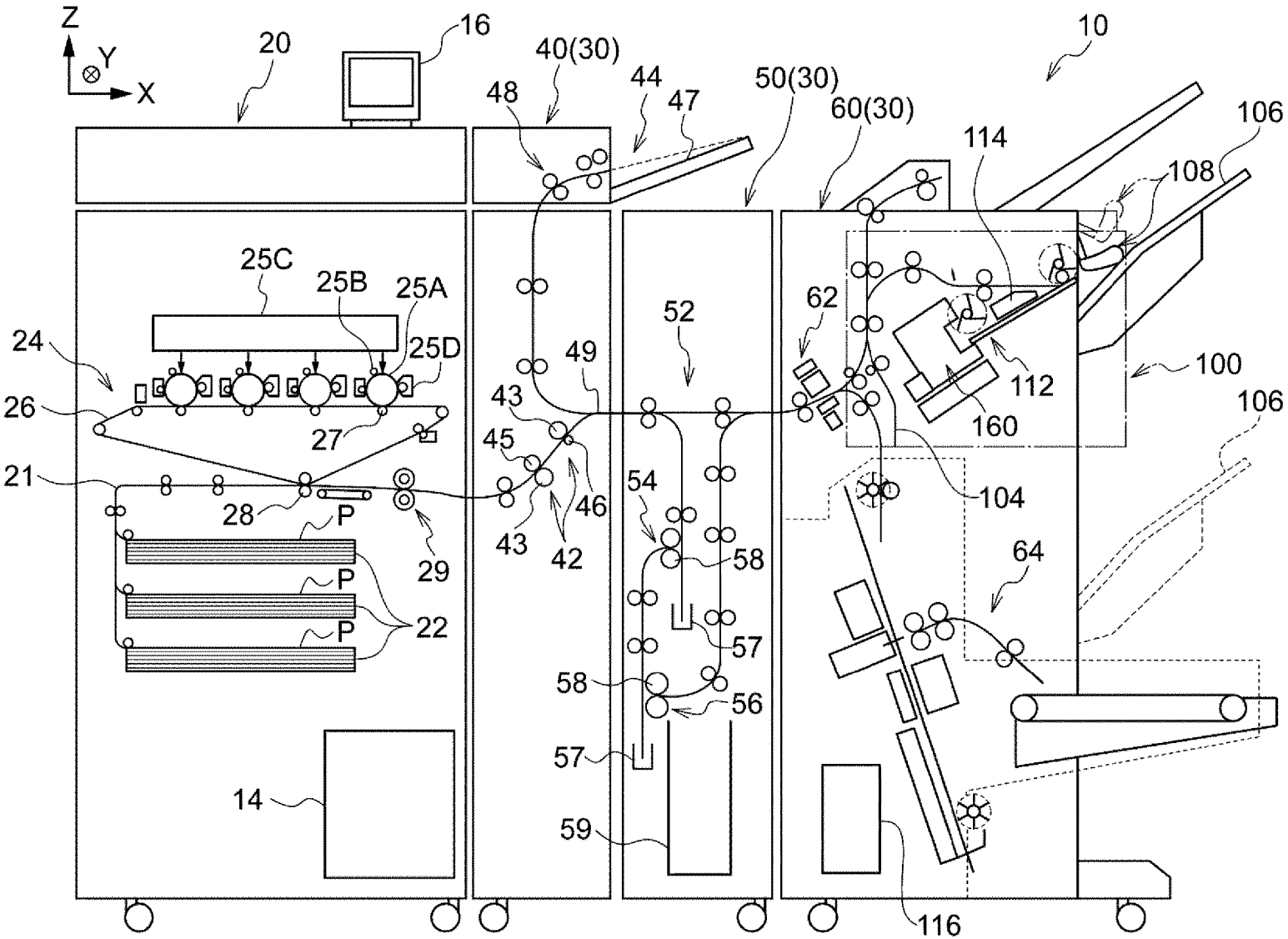
FIG. 1 is a schematic diagram showing an overall configuration of an image forming system including a sheet discharge device according to a first exemplary embodiment.

FIG. 1 shows an image forming system 10 including a sheet discharge device 100 according to a first exemplary embodiment. As an example, the image forming system 10 includes an image forming device main body 20 that forms an image, and a post-processing device 30 that performs post-processing on a sheet member P on which the image is recorded by the image forming device main body 20. The post-processing device 30 includes the sheet discharge device 100 to be described later. The sheet member P is an example of a sheet. As the sheet member P, for example, a sheet or the like is used. The image forming system 10 is an example of the image forming device, and the image forming device main body 20 is an example of an image forming unit.

<Image Forming Device Main Body>

The image forming device main body 20 includes a sheet feeding unit 22 that feeds the sheet member P to the conveyance path 21, and a forming unit 24 that forms an image on the sheet member P fed from the sheet feeding unit 22. The forming unit 24 includes a charging device 25B that charges the outer circumferential surface of the photosensitive body 25A, an exposure unit 25C that exposes the outer circumferential surface of the photosensitive body 25A based on image information, and a developing device 25D that develops the exposed latent image of the photosensitive body 25A with toner (forms a toner image).

The forming unit 24 includes an intermediate transfer belt 26 that is provided so as to be rotatable, a primary transfer roll 27 that primarily transfers the toner images to the intermediate transfer belt 26, and a secondary transfer roll 28 that secondarily transfers the toner images superimposed on the intermediate transfer belt 26 to the sheet member P. The forming unit 24 further includes a fixing unit 29 that fixes the toner image secondarily transferred to the sheet member P. In the forming unit 24, as an example, the number of colors of the toner image to be used is four, and the photosensitive body 25A, the charging device 25B, the developing device 25D, and the primary transfer roll 27 are provided for each color.

The image forming device main body 20 includes a control device 14 that performs overall management control of operations of respective parts of the image forming system 10, and an operation panel 16 that is operated by a user. The operation panel 16 is, for example, a touch panel display, and is configured to display an operation menu, receive an operation instruction such as a processing request from a user, and display selection information for the user and an operation state of the device.

<Post-Processing Device>

The post-processing device 30 includes plural units that receive the sheet member P output from the image forming device main body 20, and perform predetermined post-processing on the received sheet member P. Specifically, the post-processing device 30 includes a third unit 60 including a first unit 40, a second unit 50, and the sheet discharge device 100 that are arranged in the X direction in the conveyance order of the sheet member P.

(First Unit)

The first unit 40 is connected to a sheet discharge port of the image forming device main body 20, receives the sheet member P output from the image forming device main body 20, performs a curl correction processing to be described later, and then conveys the sheet member P to the second unit 50. The first unit 40 includes a curl correction processing unit 42 that performs curl correction on the sheet member P, and a sheet supply unit 44 that separately stores a sheet member (not shown) serving as a cover and supplies (adds) the sheet member as a cover of a booklet.

In the curl correction processing unit 42, a nip is formed in a manner that a sponge roll 43 bites into rolls 45 and 46 thinner than the sponge roll 43. Then, the curl correction processing unit 42 performs curl correction by sandwiching the sheet member P curled by the fusion of the toner in the image forming device main body 20 and the heating and pressing at the time of fixing between the sponge roll 43 and the roll 45 and between the sponge roll 43 and the roll 46.

The sheet supply unit 44 includes a paper feeding tray 47 provided in an upper portion of the housing of the first unit 40 and configured to receive thick sheets (including slip sheets) for a cover, and a delivery mechanism 48 configured to deliver the thick sheets on the paper feeding tray 47 one by one. The thick paper supplied by the sheet supply unit 44 is conveyed to the second unit 50 through a sheet guide path 49 provided in the first unit 40.

(Second Unit)

The second unit 50 is connected to a sheet discharge port of the first unit 40, receives the sheet member P (including thick paper) output from the first unit 40, performs a folding processing to be described later, and then conveys the sheet member P to the third unit 60. When the folding processing of the sheet member P is not necessary, the second unit 50 conveys the sheet member P to the third unit 60 in an unprocessed state. The second unit 50 includes a folding processing unit 52 that performs folding processing on the sheet member P.

The folding processing unit 52 includes a first folding unit 54 that performs a first folding processing and a second folding unit 56 that performs a second folding processing. Each of the first folding unit 54 and the second folding unit 56 includes an end guide 57 for stopping the sheet member P and a folding roll 58 for folding the sheet member P. In the folding processing unit 52, the folding positions of the first folding unit 54 and the second folding unit 56 are changed by the forward and backward movement of the respective end guides 57. The folding processing unit 52 includes a folder tray 59 that may be pulled out to the outside.

(Third Unit)

The third unit 60 includes a hole-forming processing unit 62 that performs hole-forming processing on the sheet members P as necessary, the sheet discharge device 100, and a bookbinding function unit 64 that saddle-binds and binds a bundle of the sheet members P. The third unit 60 further includes a stapling mechanism unit 160, which will be described later, for binding the bundle of aligned sheet members P.

<Configuration of Main Part>

Next, the sheet discharge device 100 will be described.

Figure 2:
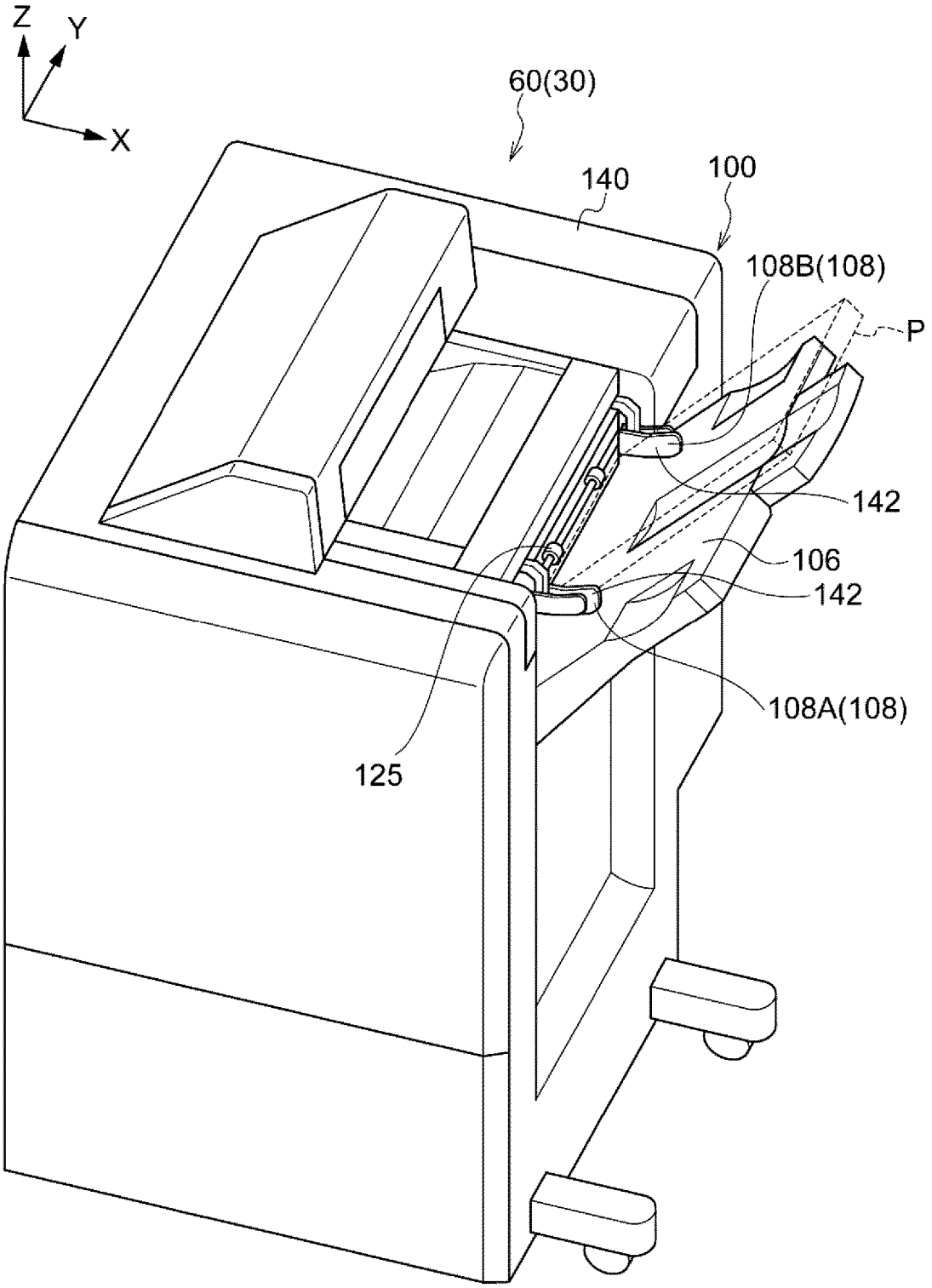
FIG. 2 is a perspective view showing the sheet discharge device according to the first exemplary embodiment.
Figure 3:
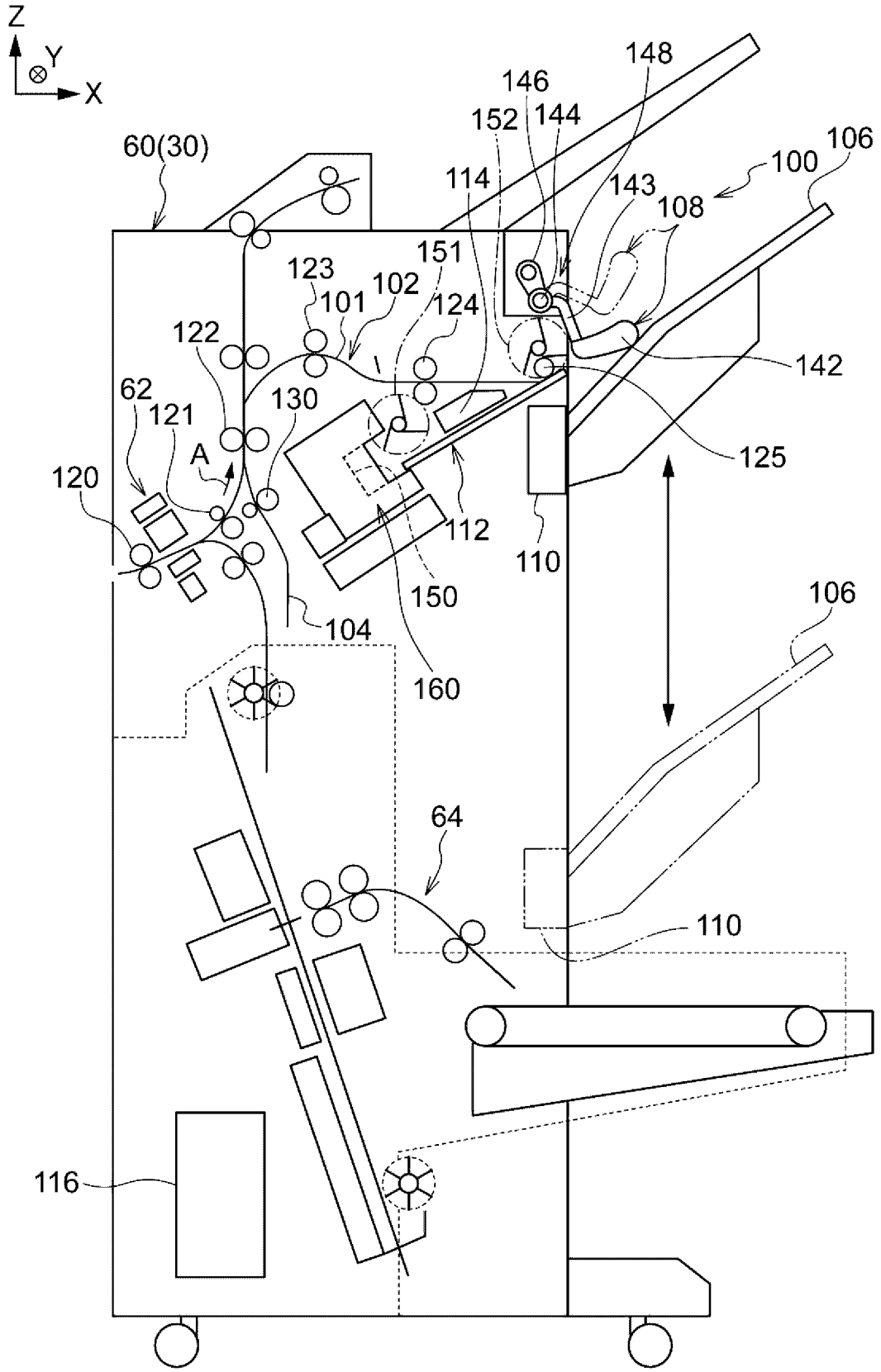
FIG. 3 is a configuration diagram showing the sheet discharge device according to the first exemplary embodiment.

As shown in FIG. 3, the sheet discharge device 100 includes a conveyance unit 102 that conveys the sheet member P along a conveyance path 101, and a buffer path 104 that temporarily stores the sheet member P in the middle of the conveyance path 101. The sheet discharge device 100 includes a stacker tray 106 to which the sheet member P having been subjected to the respective processing is discharged, and a tamper 108 that aligns the sheet member P discharged to the stacker tray 106 (see FIG. 2). The sheet discharging device 100 includes a moving unit 110 (so-called offset unit) that moves the stacker tray 106 in a direction (sheet depth direction in the present exemplary embodiment) intersecting the convey direction of the sheet member P. Here, the buffer path 104 is an example of a storage unit. The stacker tray 106 is an example of a discharge unit. The tamper 108 is an example of a processing unit that performs processing on the sheet member P, and is an example of an alignment unit of the processing unit.

The sheet discharge device 100 includes a compile tray 112 that temporarily collects the sheet members P in the middle of the conveyance path 101, and a second tamper 114 that aligns the sheet members P placed on the compile tray 112. The compile tray 112 is disposed on the conveyance path 101 on the downstream side in the convey direction of the sheet member P with respect to the position where the buffer path 104 is provided. The sheet discharge device 100 further includes a control unit 116 that controls the operation of each member of the sheet discharge device 100. The compile tray 112 is an example of a stacking unit, and the second tamper 114 is an example of another alignment unit.

(Conveyance Unit)

The conveyance unit 102 includes plural conveyance rollers 120, 121, 122, 123, and 124 that conveyance the sheet member P along the conveyance path 101. The plural conveyance rollers 120, 121, 122, 123, and 124 include a pair of rollers that conveyance the sheet member P while sandwiching the sheet member P therebetween, and are disposed at intervals along the conveyance path 101.

The conveyance rollers 120 and 121 are disposed on the upstream side in the convey direction of the sheet member P with respect to the position where the conveyance path 101 branches off from the buffer path 104. The conveyance rollers 120 and 121 conveyance the sheet member P in a normal convey direction (arrow A direction) by rotation. In a first mode, which will be described later, in which the buffer path 104 is not used, the rotation of the conveyance rollers 121 is stopped, thereby causing the sheet member P to stand by.

The conveyance rollers 122 and 123 are disposed on the upper side of the buffer path 104 and on the downstream side in the convey direction of the sheet member P with respect to the position where the conveyance path 101 is branched from the buffer path 104. The conveyance rollers 122 and 123 convey the sheet member P in a normal convey direction (arrow A direction) by rotation in a forward direction. In a second mode in which a buffer path 104 to be described later is used, the conveyance rollers 122 and 123 convey the sheet member P to the buffer path 104 by rotating the sheet member P in the reverse direction with respect to the forward direction and switching back the sheet member P in the reverse direction (see FIG. 10).

Figure 7:
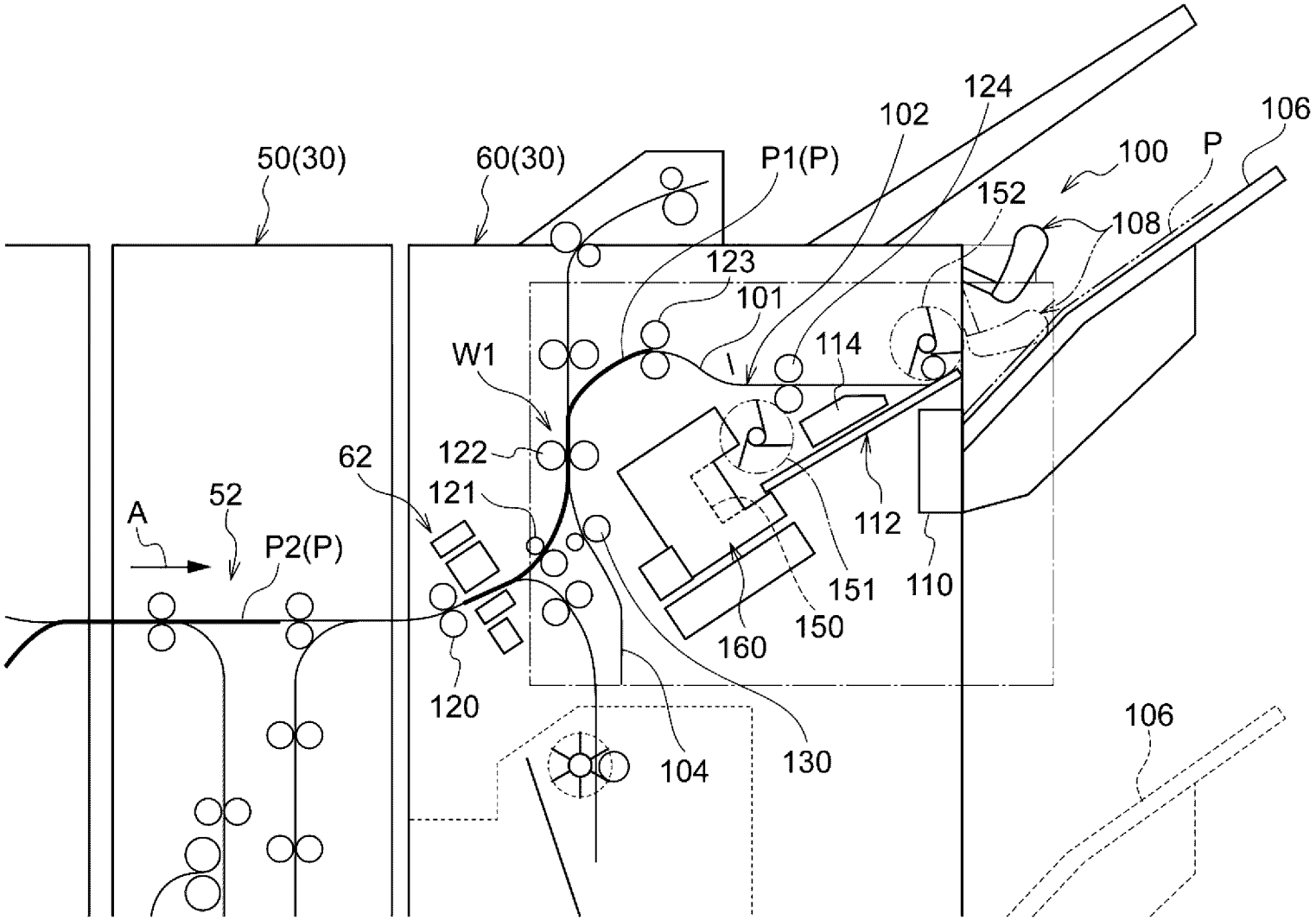
FIG. 7 is a configuration diagram showing a state in which a sheet member is on standby in the image forming system including the sheet discharge device according to the first exemplary embodiment.

In the first mode in which the buffer path 104 is not used, the conveyance rollers 122 stop rotating, thereby causing the sheet member P to stand by at a standby position W1 (see FIG. 7).

The conveyance roller 124 is disposed above the compile tray 112. The conveyance roller 124 convey the sheet member P in a normal convey direction (arrow A direction) by rotation.

(Buffer Path)

The buffer path 104 has a function of temporarily storing the sheet member P conveyed along the conveyance path 101. As shown in FIG. 3, the buffer path 104 is provided with conveyance roller 130 that convey the sheet member P. The buffer path 104 is an example of a configuration that retracts the sheet member P from the conveyance path 101. As an example, the buffer path 104 branches off from the middle of the conveyance path 101 in a vertical direction (in the present exemplary embodiment, the middle of the conveyance of the sheet member P from a lower side to an upper side in the vertical direction), and extends downward. That is, the buffer path 104 is arranged along the vertical direction.

In the second mode to be described later in which the buffer path 104 is used, the conveyance rollers 122 and 123 are rotated in the reverse direction, and the conveyance roller 130 is rotated in the reverse direction. As a result, the sheet member P conveyed to the conveyance rollers 122 and 123 is switched back in the direction opposite to the normal convey direction (the direction of arrow A), and thereby the sheet member P is stored in the buffer path 104 (see FIG. 10). By temporarily storing the sheet member P in the buffer path 104, the conveyance of the sheet member P discharged to the stacker tray 106 is delayed as compared with a case where the buffer path 104 is not used. In a state in which the sheet member P is stored in the buffer path 104, a portion of the sheet member P (in the present exemplary embodiment, an upper portion of the sheet member P shown in FIG. 10) is positioned in the conveyance path 101, and the sheet member P is sandwiched between the conveyance roller 122.

As an example, the buffer path 104 is configured to be capable of storing up to two sheet members P. The one or more sheet members P stored in the buffer path 104 return from the buffer path 104 to the conveyance path 101 by rotating the conveyance rollers 122 and 123 in the forward direction and rotating the conveyance roller 130 in the forward direction. Then, the sheet member P is conveyed through the conveying path 101 in the normal convey direction (arrow A direction).

As an example, in a case where the length of the sheet member P is longer than the length of the A4 size in a lateral direction, or in a case where the basis weight of the sheet member P is larger than a predetermined basis weight, the sheet member P may not be stored in the buffer path 104. In the sheet discharge device 100 of the present exemplary embodiment, when the sheet member P satisfies all of the following conditions (1) to (3), the sheet member P may be stored in the buffer path 104.

(1) A length of the sheet member Pin the convey direction is 182 mm or more and 216 mm or less.

(2) A width of the sheet member P in the direction orthogonal to the convey direction is 257 mm or more and 297 mm or less.

(3) The basis weight of the sheet member P is 52 gsm or more and 106 gsm or less.

(Stacker Tray or Moving Unit)

As shown in FIGS. 2 and 3, the stacker tray 106 has a function of discharging the sheet member P on which an image has been formed by the image forming device main body 20 (see FIG. 1) and each processing has been completed. The stacker tray 106 protrudes outward from a housing 140 forming the sheet discharge device 100. The sheet member P discharged from the housing 140 to the outside is stacked on the stacker tray 106. As an example, the surface of the buffer path 104 to which the sheet member P is discharged is inclined such that the downstream side in the convey direction of the sheet member P is higher than the upstream side. The stacker tray 106 may be raised and lowered in a vertical direction indicated by an arrow by a raising and lowering unit (not shown) disposed inside the housing 140.

An output roller 125 that discharges the sheet member P to the stacker tray 106 is provided on the housing 140 side of the stacker tray 106. The output roller 125 is a single roller, and is disposed at a position facing the upper end portion of the compile tray 112.

The stacker tray 106 may be moved by the moving unit 110 in a direction intersecting with the convey direction of the sheet member P (in the present exemplary embodiment, in the device depth direction). Although not shown, the moving unit 110 is configured to move the stacker tray 106 in the device depth direction by a cam, for example.

(Tamper)

As shown in FIGS. 2 and 3, the tamper 108 has a function of aligning the sheet members P discharged to the stacker tray 106 in a width direction intersecting the convey direction. The tamper 108 includes tamper bodies 108A and 108B disposed above the stacker tray 106 in a manner of forming a pair in the device depth direction (arrow Y direction), that is, in the width direction of the sheet member P. The tamper bodies 108A and 108B are configured to be symmetrical in the device depth direction.

Each of the tamper bodies 108A and 108B includes a plate-shaped portion 142 disposed along the vertical direction, an arm 143 extending from the plate-shaped portion 142 toward the housing 140, and a rotating portion 144 provided at an end portion of the arm 143 opposite to the plate-shaped portion 142 in the longitudinal direction (see FIG. 3). The rotating portion 144 rotates the arm 143 and the plate-shaped portion 142 in the vertical direction. The tamper 108 includes a drive unit 146 that moves the tamper bodies 108A and 108B in the device depth direction (the arrow Y direction) in a manner of sandwiching the sheet member P. The tamper 108 includes a retraction portion 148 (see FIG. 4) on the upper side of the stacker tray 106 with respect to the tamper main bodies 108A and 108B by rotating the rotating portion 144. The retraction portion 148 is, for example, a motor that rotates the rotating portion 144.

When aligning the sheet members P discharged to the stacker tray 106 in the width direction, the tamper 108 rotates the tamper bodies 108A and 108B in a direction approaching the stacker tray 106 by the rotation unit 108A and 108B. Then, by moving the tamper bodies 108A and 108B in the device depth direction (arrow Y direction) by the drive unit 146, the sheet members P on the stacker tray 106 are aligned in the width direction.

The tamper 108 rotates the rotation portion 144 by the retraction portion 148, thereby rotating the tamper bodies 108A and 108B upward with respect to the stacker tray 106. As a result, the tamper bodies 108A and 108B are retracted from the stacker tray 106. For example, when the stacker tray 106 is moved in the device depth direction by the moving unit 110, the tamper bodies 108A and 108B are rotated upward with respect to the stacker tray 106 by the retraction portion 148 such that the tamper bodies 108A and 108B do not interfere with the sheet members P stacked on the stacker tray 106.

(Compile Tray and Second Tamper)

As shown in FIG. 3, the compile tray 112 has a function of temporarily accumulating the sheet members P on the upstream side of the stacker tray 106 in the convey direction of the sheet members P. The upper surface of the compile tray 112 is inclined such that the downstream side in the convey direction of the sheet member P is higher than the upstream side in the device height direction (the arrow Z direction).

An end wall portion 150 against which the sheet member P abuts in the vertical direction is provided on the lower side of the compile tray 112. Two paddles 151 and 152 that move the sheet member P in a direction in which the sheet member P abuts against the end wall portion 150 are provided on the upper side of the compile tray 112. The paddles 151 and 152 are spaced apart from each other on an upper side and a lower side of the compile tray 112. The sheet member P placed on the compile tray 112 abuts against the end wall portion 150 by the rotation of the paddles 151 and 152, thereby aligning the longitudinal direction of the sheet member P.

As an example, the compile tray 112 is configured to be capable of storing plural (for example, 100 at maximum) sheet members P. In the sheet discharge device 100, for example, the sheet member P is conveyed to the compile tray 112 side by the rotation of the conveyance rollers 124. In the compile tray 112, the sheet member P is conveyed in a direction in which the sheet member P abuts against the end wall portion 150 by the rotation of the output roller 125 in the opposite direction and the rotation of the paddles 151 and 152, and thereby placing the sheet member P on the compile tray 112.

The second tamper 114 disposed on the upper side of the compile tray 112 has a function of aligning the sheet members P placed on the compile tray 112 in the width direction intersecting the convey direction. Although not illustrated in the drawings, the second tamper 114 includes a tamper body that is disposed as a pair in the device depth direction. The pair of tamper bodies are moved in the device depth direction by a driving unit (not illustrated), and thereby the sheet members P on the compile tray 112 are aligned in the width direction.

The plural sheet members P stacked on the compile tray 112 may bind a bundle of the sheet members P (that is, perform stapling) by the staple mechanism unit 160 in a state in which the sheet members P abut against the end wall portion 150. The post-processing by the stapling mechanism unit 160 is performed when the stapling processing is received by the control unit 116.

(Control Unit)

Figure 4:
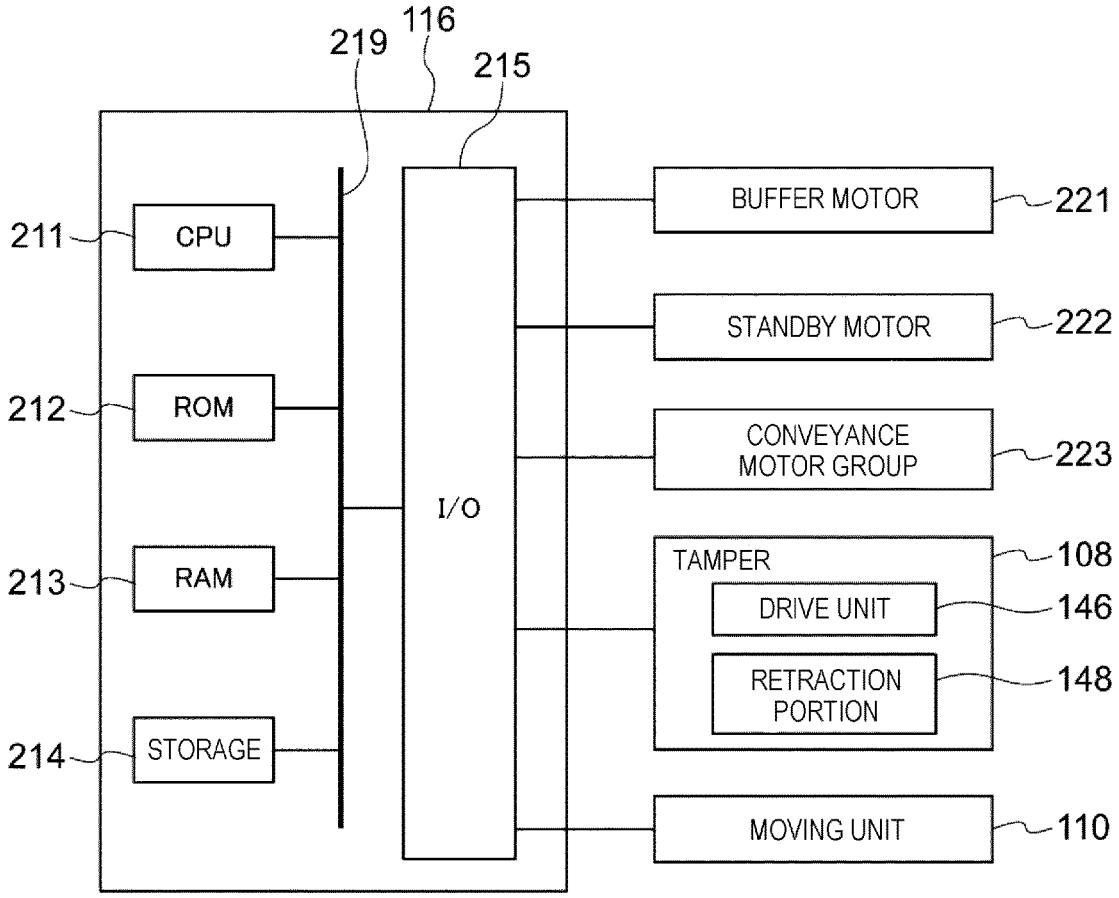
FIG. 4 is a block diagram showing a hardware configuration of a control device of the sheet discharge device according to the first exemplary embodiment.

FIG. 4 is a block diagram showing a hardware configuration of the control unit 116.

As shown in FIG. 4, the control unit 116 includes configurations of a central processing unit (CPU) 211, a read only memory (ROM) 212, a random access memory (RAM) 213, a storage 214, and an input and output interface (I/O) 215. The respective configurations are connected to each other via a bus 219 so as to be able to communicate with each other.

The CPU 11 is a central arithmetic processing unit, and executes various programs and controls each unit. That is, the CPU 211 reads the program from the ROM 212 or the storage 214, and executes the program using the RAM 213 as a work area. The CPU 211 controls the above components and performs various types of arithmetic processing in accordance with the programs recorded in the ROM 212 or the storage 214. In the present exemplary embodiment, the ROM 212 or the storage 214 stores a transfer processing program.

The ROM 212 stores various programs and various data. The RAM 13 temporarily stores programs or data as the work area. The storage 214 includes a hard disk drive (HDD) or a solid state drive (SSD), and stores various programs including a conveyance processing system and various data. The storage 214 stores a program of a printer driver. The CPU 211 functions as the printer driver by reading a program of the printer driver from the storage 214 and executing the program.

An input and output interface 215 is an interface for inputting and outputting signals to and from other members. In the present exemplary embodiment, the input and output interface 215 is communicably connected to a buffer motor 221, a standby motor 222, a conveyance motor group 223, the tamper 108, and the moving unit 110. The CPU 211 controls operations of the buffer motor 221, the standby motor 222, the conveyance motor group 223, the tamper 108, and the moving unit 110.

The buffer motor 221 stops rotation in the forward direction, rotation in the reverse direction or rotation of the conveyance rollers 122 and 123. For example, the buffer motor 221 rotates the conveyance rollers 122 and 123 in the reverse direction to store the sheet member P in the buffer path 104.

The standby motor 222 stops rotation (rotation in the forward direction), or rotation of the conveyance roller 121. For example, the standby motor 222 stops the rotation of the conveyance roller 121, and the buffer motor 221 stops the rotation of the conveyance roller 122, and thereby the sheet member P stands by at the standby position W1.

For example, the conveyance motor group 223 rotates (rotates in the forward direction) the conveyance rollers 120 and 124 and the like in order to convey the sheet member P in the normal convey direction (the direction of arrow A).

In the present exemplary embodiment, the control unit 116 changes the alignment of the sheet members P by the tamper 108 depending on whether or not there is storage control for storing the sheet members P in the buffer path 104. More specifically, the control unit 116 has a first mode in which there is no storage control for storing the sheet member P in the buffer path 104, and a second mode in which there is storage control for storing the sheet member P in the buffer path 104. That is, the first mode is a mode in which sheet alignment by the tamper 108 is performed without performing storage control by the buffer path 104 (without retracting the sheet member P from the conveyance path 101 to the buffer path 104). The second mode is a mode in which the storage control by the buffer path 104 is performed and the sheet alignment by the tamper 108 is performed. The first mode is an example of a mode.

For example, the control unit 116 executes the second mode when the sheet member P is longer than the length of the A4 size in the lateral direction or when the basis weight of the sheet member P is larger than the predetermined basis weight. In the present exemplary embodiment, when the sheet member P satisfies all of the following conditions (1) to (3), the control unit 116 sets the sheet member P to be buffered to be stored in the buffer path 104 (see "sheet member P4" in FIG. 10), and executes the second mode. That is, when the sheet member P does not satisfy any one or more of the following conditions (1) to (3), the first mode is executed.

(1) A length of the sheet member Pin the convey direction is 182 mm or more and 216 mm or less.

(2) A width of the sheet member P in the direction orthogonal to the convey direction is 257 mm or more and 297 mm or less.

(3) The basis weight of the sheet member P is 52 gsm or more and 106 gsm or less.

In the first mode, the control unit 116 discharges one sheet member P to the stacker tray 106, and causes the tamper 108 to align the two sheet members P discharged to the stacker tray 106 once. Here, the sheet member alignment is an example of sheet alignment. Accordingly, the two sheet members P are aligned in the width direction. As an example, in the first mode, when the sheet member P is conveyed along the conveyance path 101, the control unit 116 discharges the sheet member P to the stacker tray 106 without passing through the compile tray 112 (bypassing the compile tray 112).

As shown in FIG. 7, in the first mode, the control unit 116 controls the conveyance unit 102 so as to cause the sheet member P, one time per two sheet members P conveyed along the conveyance path 101, to stand by in the middle of the conveyance path 101 to such an extent that the sheet member P does not interfere with the sheet member P (see "rear sheet member P2" in FIG. 7) conveyed on the rear side of the sheet member P (see "sheet member P1" in FIG. 7) conveyed on the conveyance path 101. In the present exemplary embodiment, the control unit 116 controls the standby motor 222 and the buffer motor 221 to stop the rotation of the conveyance rollers 121 and 122, and cause the sheet member P1 to stand by at the standby position W1. Here, the rear sheet member P2 is an example of a rear sheet.

The control unit 116 causes the an odd-numbered sheet member P or even-numbered sheet member P in the number of conveyed sheets, one time per two sheets of the sheet member P conveyed along the conveyance path 101, to stand by in the middle of the conveyance path 101 to such an extent that the sheet member P does not interfere with the sheet member P (see "rear sheet member P2" in FIG. 7) conveyed on the rear side of the sheet member P conveyed on the conveyance path 101.

Figure 10:
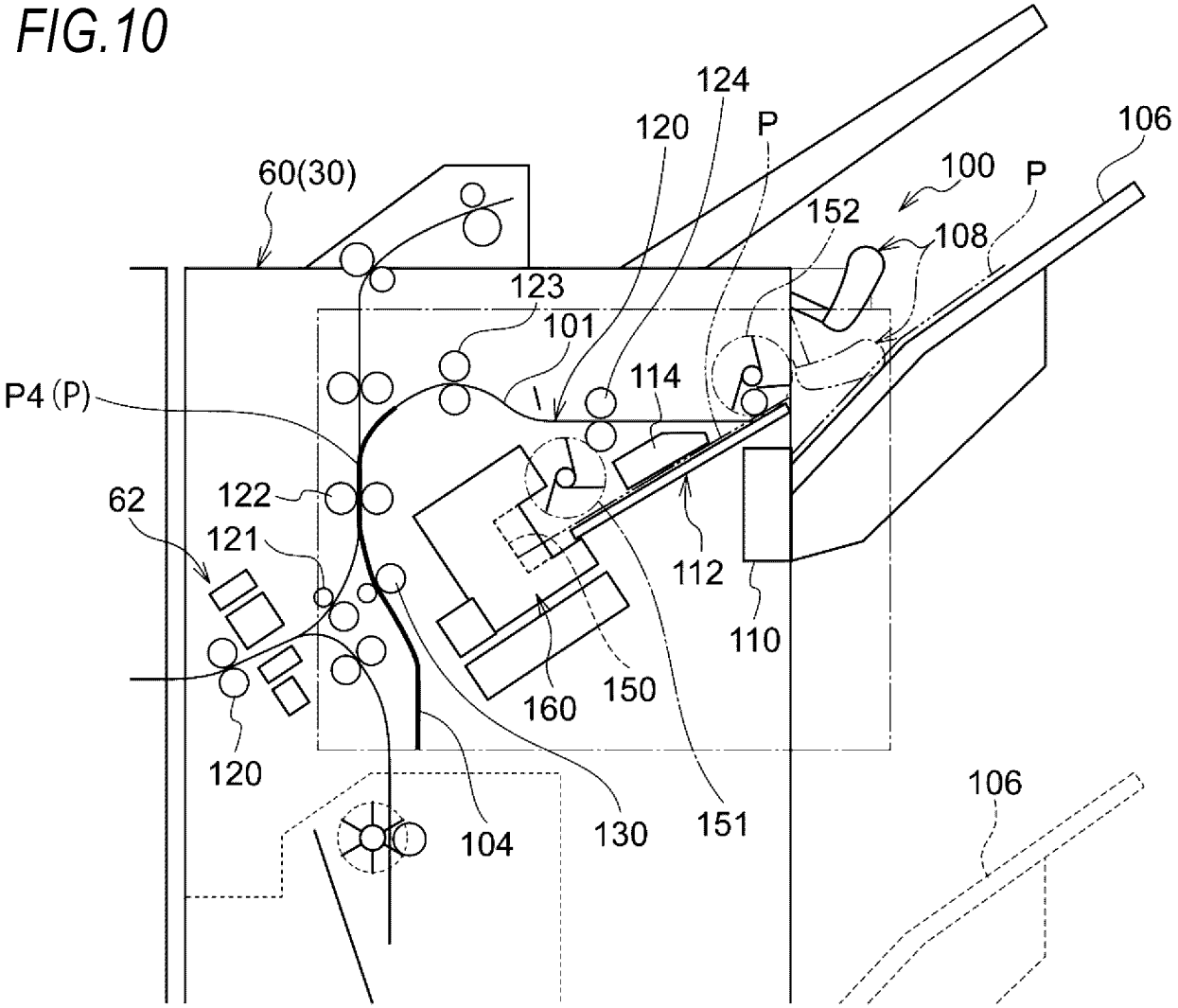
FIG. 10 is a configuration diagram showing a state in which a sheet member is in a state of being stored in a buffer path in the image forming system including the sheet discharge device according to the first exemplary embodiment.

As shown in FIG. 10, in the second mode, the control unit 116 stores the sheet member P to be buffered (see "sheet member P4" in FIG. 10) in the buffer path 104. For example, when the sheet member P4 is conveyed to the positions of the conveyance rollers 122 and 123, the control unit 116 causes the buffer motor 221 to rotate the conveyance rollers 122 and 123 in a direction opposite to the forward rotation, thereby storing the sheet member P4 in the buffer path 104. Thereafter, the control unit 116 discharges the stored sheet member P4 to the stacker tray 106 together with a rear sheet member (not shown) conveyed on a rear side of the sheet member P4, and performs sheet member alignment by the tamper 108 with respect to one discharge. Here, the rear sheet member is an example of the rear sheet. Accordingly, at least two sheet members P are aligned in the width direction.

In the second mode, after at least two sheet members P4 are stacked and stored in the buffer path 104, the control unit 116 may discharge the stacked sheet members P4 to the stacker tray 106 together with a rear sheet member (not shown), and perform sheet member alignment by the tamper 108 with respect to one discharge. Accordingly, at least three sheet members P are aligned in the width direction.

In the second mode, after the sheet member P is temporarily placed on the compile tray 112, the control unit 116 may discharge the sheet member P from the compile tray 112 to the stacker tray 106. In the compile tray 112, the sheet members P placed on the compile tray 112 may be aligned by the tamper 114.

<Operation>

Next, an operation of the present exemplary embodiment will be described.

Figure 5:
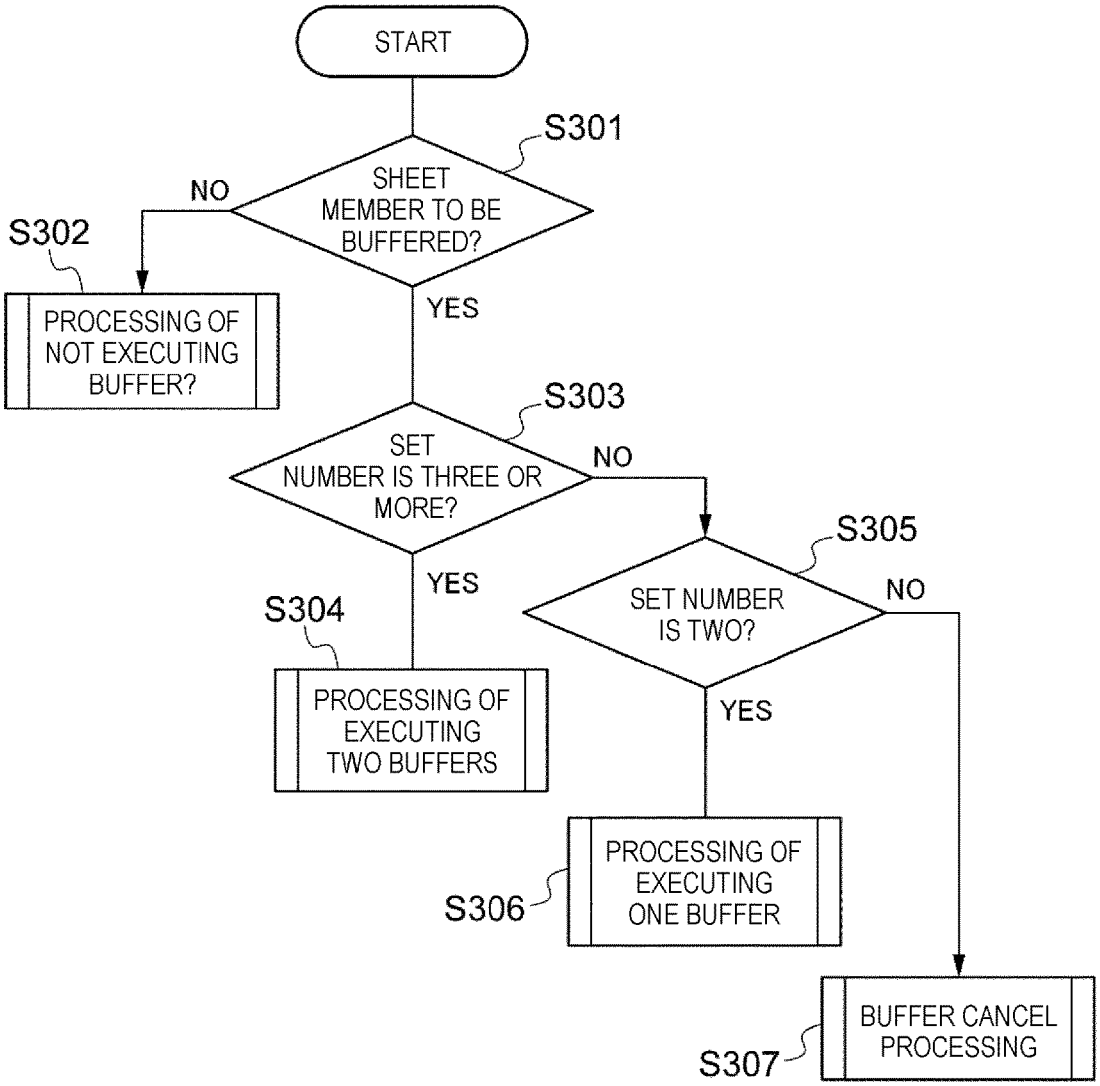
FIG. 5 is a flowchart showing a flow of processing of conveyance control of the control device according to the first exemplary embodiment.

FIG. 5 is a flowchart showing a flow of a conveyance processing of the sheet member P by the control unit 116. In the control unit 116, the CPU 211 reads the conveyance processing program from the ROM 212 or the storage 214, loads the conveyance processing program into the RAM 213 and executes the conveyance processing program, thereby performing the conveyance processing. In the present exemplary embodiment, a sheet member P is used as an example of a sheet, and the sheet member P may be referred to as a sheet in FIG. 5 and other flowcharts (FIGS. 6, 9, 11, and 12). The stacker tray 106 is used as the example of the discharge unit, and the stacker tray 106 may be referred to as a discharge unit.

As shown in FIG. 5, when the conveyance processing of the sheet member P is started, the CPU 211 determines whether the sheet member P is a target of storage control by the buffer path 104 (that is, the sheet member P to be buffered) (step S301). For example, when the sheet member P satisfies all of the conditions (1) to (3), the CPU 211 determines that the sheet member P is a sheet member P to be buffered to be stored in the buffer path 104. When the sheet member P is the sheet member P to be buffered to be stored in the buffer path 104, the second mode is executed.

When the sheet member P is not the sheet member P to be buffered (step S301: NO), the CPU 211 executes a processing of not executing the buffer (step S302). According to the present exemplary embodiment, when the sheet member P is not the sheet member P to be buffered to be stored in the buffer path 104, the first mode is executed.

When the sheet member P is a sheet member P to be buffered (step S301: YES), the CPU 211 determines whether the set number of sheet members P is three or more (step S303). Here, the set number of sheets is the number of sheet members P to be discharged to the stacker tray 106 in one set (for example, one job set).

When the set number of sheet members P is three or more (step S303: YES), the CPU 211 executes a processing of executing a buffer for storing the sheet members P in the two-sheet buffer path 104 (step S304).

When the set number of sheet members P is not three or more (step S303: NO), the CPU 211 determines whether the set number of sheet members P is two or more (step S305).

When the set number of sheet members P is two or more (step S305: YES), the CPU 211 executes a processing of executing a buffer for storing the sheet members P in the one-sheet buffer path 104 (step S306).

When the set number of sheet members P is not two or more (step S305: NO), the CPU 211 executes buffer cancel processing (step S307). As an example, the buffer cancellation processing is a processing of temporarily storing one sheet member P in the buffer path 104, placing the sheet member P on the compile tray 112, and then discharging the sheet member P to the stacker tray 106.

Figure 6:
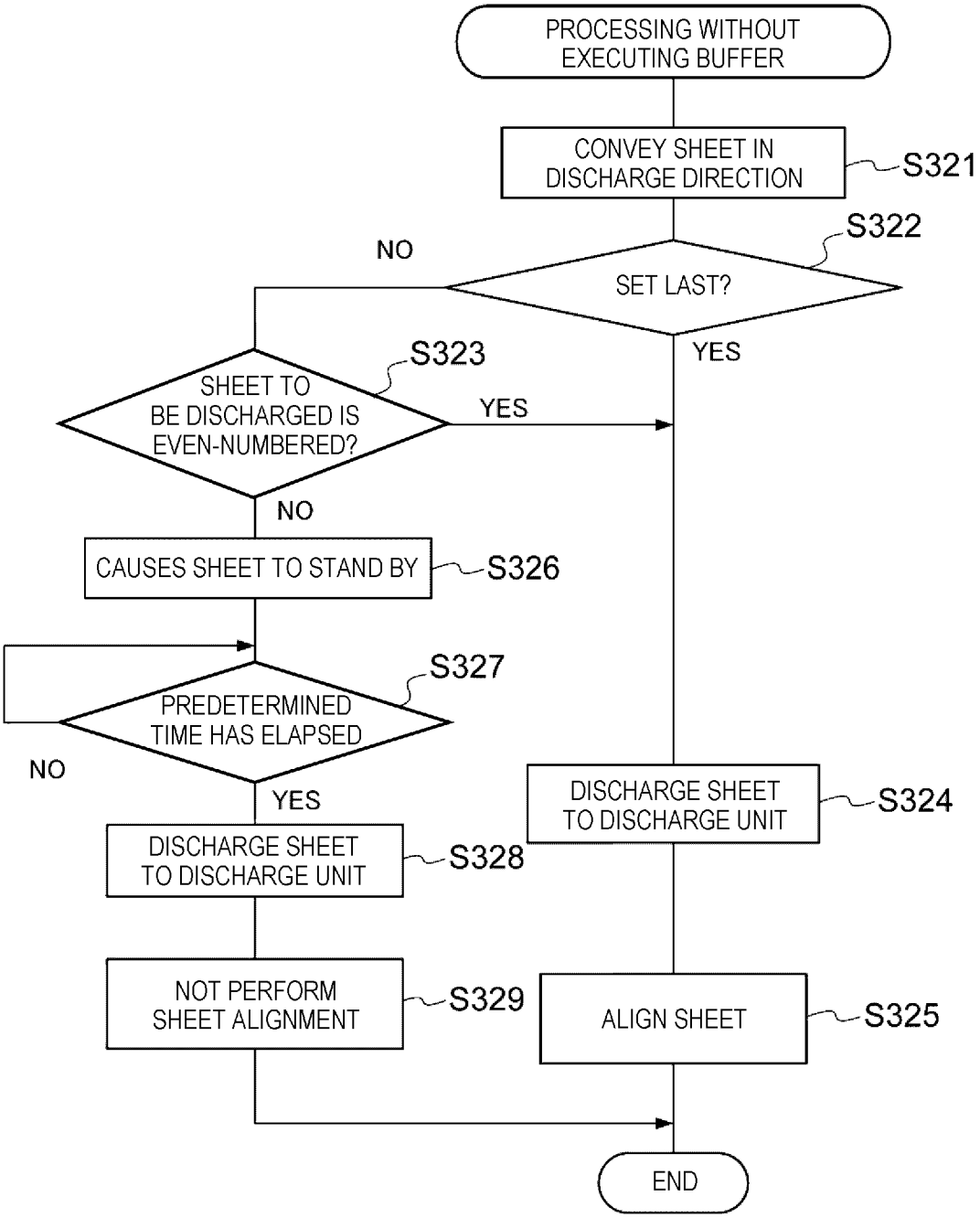
FIG. 6 is a flowchart showing a flow of processing performed by the control device according to the first exemplary embodiment when a buffer is not implemented.

FIG. 6 is a flowchart showing a flow of a processing performed by the control unit 116 without executing the buffer.

As shown in FIG. 6, when the processing of not performing the buffering of the sheet member P is started, the CPU 211 conveys the sheet member P in a discharge direction, that is, in the convey direction (arrow A direction) along the conveyance path 101 (step S321).

The CPU 211 determines whether the sheet member P is set last (step S322).

Here, "last set" refers to a sheet member P that is finally discharged to the stacker tray 106 when plural sheet members P are sequentially conveyed in one set (for example, one job set). For example, when the set number of the sheet members P is three, the third sheet member is the sheet member P to be finally discharged to the stacker tray 106.

When the sheet member P is not set last (step S322: NO), the CPU 211 determines whether the sheet member P to be discharged is an even-numbered sheet (step S323).

When the sheet member P is set last (step S322: YES), or when the sheet member P to be discharged is an even-numbered sheet member P (step S323: YES), the CPU 211 discharges the sheet member P to the stacker tray 106 as an example of the discharge unit (step S324). At this time, the CPU 211 discharges the sheet member P conveyed along the conveyance path 101 to the stacker tray 106 without passing through the compile tray 112.

Next, the CPU 211 causes the tamper 108 to align the sheet members P discharged to the stacker tray 106 in the width direction (step S325). Accordingly, the sheet alignment in the width direction of the even-numbered sheet member P discharged to the stacker tray 106 is performed by the tamper 108. When the sheet member P is set last (that is, when the sheet member P is the sheet member P to be discharged last), the sheet alignment in the width direction of the sheet member P by the tamper 108 is performed on the sheet member P discharged to the stacker tray 106.

When the sheet member P to be discharged is not an even-numbered sheet member P (step S323: NO), the CPU 211 causes the sheet member P to stand by at the standby position W1 inside the sheet discharge device 100 (step S326). That is, when the sheet member P to be discharged is an odd-numbered sheet member P, the CPU 211 causes the sheet member P to stand by at the standby position W1 inside the sheet discharge device 100 (the sheet member P1 shown in FIG. 7).

The CPU 211 determines whether a predetermined time has elapsed (step S327). When the predetermined time has not elapsed (step S327: NO), the CPU 211 stands by until the predetermined time elapses. In the present exemplary embodiment, the sheet member P1 shown in FIG. 7 is kept on standby at the standby position W1 until a predetermined time elapses. For example, the predetermined time period is a time period during which the sheet member P1 does not interfere with the rear sheet member P2 conveyed on the rear side of the sheet member P1.

Figure 8:
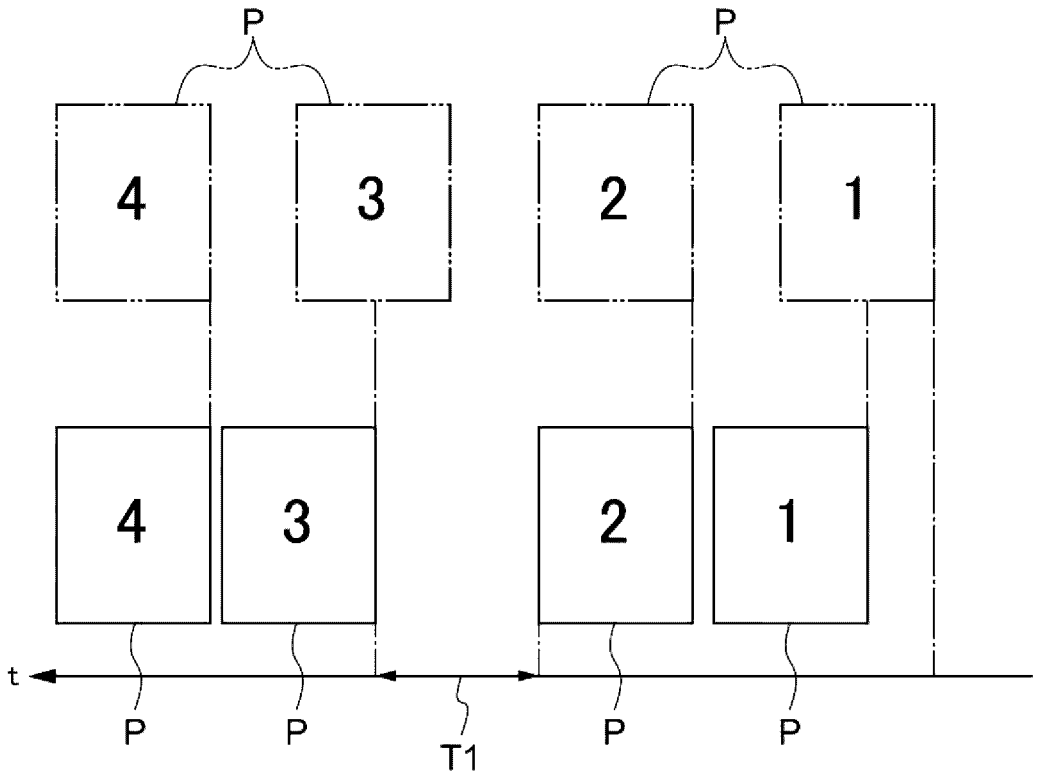
FIG. 8 is a schematic diagram showing a conveyance state of plural sheet members sequentially conveyed in the image forming system including the sheet discharge device according to the first exemplary embodiment.

FIG. 8 is a diagram schematically showing conveyance intervals of plural sheet members P discharged to the stacker tray 106 when the horizontal axis direction is time (t). As shown in FIG. 8, in a case where plural sheet members P are sequentially conveyed in the discharge direction, when the sheet member P to be discharged is an odd-numbered sheet member P (see the first sheet and the third sheet in FIG. 8), the conveyance of the sheet members P is delayed with respect to the normal discharge time (see an upper stage in FIG. 8) (see a lower stage in FIG. 8). As a result, the conveyance interval between the second sheet member P and the third sheet member P (the sheet member P1 shown in FIG. 7) becomes longer than a normal conveyance interval. Therefore, a long time T1 is secured between the second sheet member P and the third sheet member P discharged to the stacker tray 106.

When the predetermined time has elapsed (step S327: YES), the CPU 211 discharges the sheet member P to the stacker tray 106 (step S328). At this time, the CPU 211 discharges the sheet member P to the stacker tray 106 without passing through the compile tray 112.

The CPU 211 does not perform the sheet alignment by the tamper 108 on the sheet member P discharged to the stacker tray 106 (step S329). Accordingly, the sheet alignment by the tamper 108 is not performed on the odd-numbered sheet members P except for a case of the last setting. In other words, in principle, when the odd-numbered sheet member P is discharged to the stacker tray 106, the sheet alignment by the tamper 108 is not performed, but when the odd-numbered sheet member P is set last, that is, when the odd-numbered sheet member P is the sheet member P to be discharged last, the sheet alignment by the tamper 108 is performed. Accordingly, the processing by the non-execution of the buffer based on the conveyance processing program is ended.

In the process according to the non-execution of the buffer shown in FIG. 6, the odd-numbered sheet member P ("sheet member P1" shown in FIG. 7) is caused to stand by at the stand by position W1, as shown in FIG. 8, a long time T1 is secured between the second sheet member P and the third sheet member P discharged to the stacker tray 106. Therefore, it is possible to perform the sheet alignment operation in the width direction of the sheet member P by the tamper 108 between the second sheet member P and the third sheet member P. As the time T1 between the second sheet member P and the third sheet member P discharged to the stacker tray 106 becomes longer, for example, a retracting operation of the tamper 108 or an operation of moving the stacker tray 106 in the device depth direction may be performed.

Figure 9:
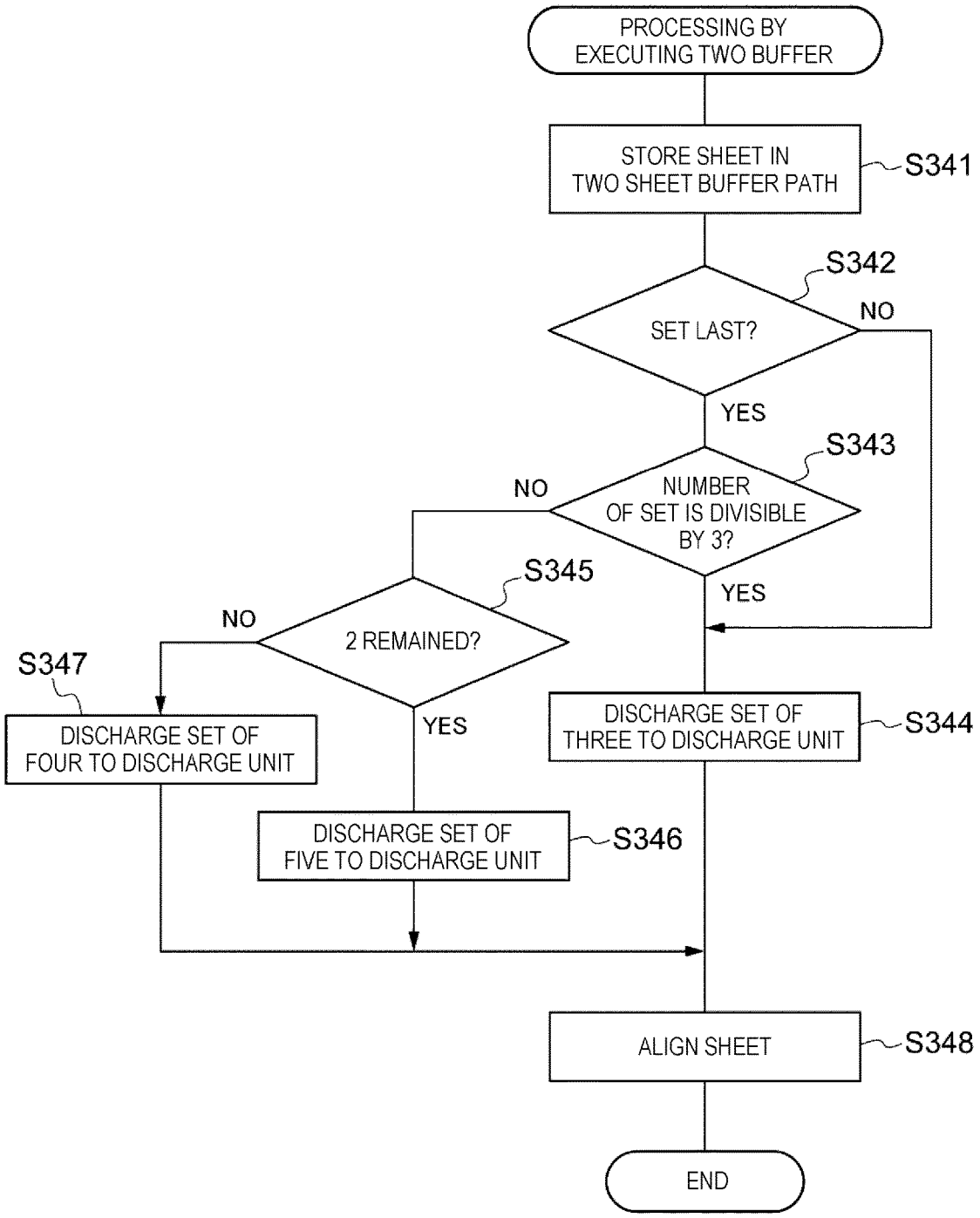
FIG. 9 is a flowchart showing a flow of a first processing performed by the control device according to the first exemplary embodiment when the buffer is implemented.

FIG. 9 is a flowchart showing a flow of a processing performed by the control unit 116 when executing two buffers.

As shown in FIG. 9, when the processing of the two-sheet buffer of the sheet member P is started, the CPU 211 stores the sheet member P in the two-sheet buffer path 104 (step S341). For example, as shown in FIG. 10, two sheet members P (see "sheet member P4" shown in FIG. 10) are temporarily stored in the buffer path 104.

The CPU 211 determines whether the sheet member P is set last (step S342). As described above, "last set" refers to a sheet member P that is finally discharged to the stacker tray 106 when the plural sheet members P are sequentially conveyed in one set (for example, one job set).

When the sheet member P is the last set (step S342: YES), the CPU 211 determines whether the set number of sheets is divisible by 3 (step S343). As described above, the set number of sheets is the number of sheet members P to be discharged to the stacker tray 106 in one set (for example, one job set).

When the number of sets is divisible by 3 (step S343: YES), the CPU 211 discharges a set of three sheet members P to the stacker tray 106 (step S344). For example, three sheet members P including the two sheet members P stored in the buffer path 104 are stacked on the compile tray 112 together with one sheet member P conveyed after the sheet members P, and then a set of three sheet members P is discharged to the stacker tray 106. When the sheet members P are stacked on the compile tray 112, sheet alignment in which the sheet members P are aligned in the width direction may be performed by the tamper 114.

When the sheet member P is not set last (step S342: NO), the CPU 211 performs the processing of step S344.

When the number of sets is not divisible by 3 (step S343: NO), the CPU 211 determines whether the remainder obtained by dividing the number of sets by 3 is 2 (step S345).

When the remainder obtained by dividing the set number of sheets by 3 is two (step S345: YES), the CPU 211 discharges a set of five sheet members P to the stacker tray 106 (step S346). For example, five sheet members P including the two sheet members P stored in the buffer path 104 are stacked on the compile tray 112 together with three sheet member P conveyed after the sheet members P, and then a set of five sheet members P is discharged to the stacker tray 106. When the sheet members P are stacked on the compile tray 112, sheet alignment in which the sheet members P are aligned in the width direction may be performed by the tamper 114.

When the remainder obtained by dividing the set number of sheets by 3 is not two (step S345: NO), the CPU 211 discharges a set of four sheet members P to the stacker tray 106 (step S347). That is, when the remainder when the number of sets is divided by 3 is not two, the remainder when the number of sets is divided by 3 is one. For example, four sheet members P including the two sheet members P stored in the buffer path 104 are stacked on the compile tray 112 together with two sheet member P conveyed after the sheet members P, and then a set of four sheet members P is discharged to the stacker tray 106. When the sheet members P are stacked on the compile tray 112, sheet alignment in which the sheet members P are aligned in the width direction may be performed by the tamper 114.

After the processing of step S344, the processing of step S346, or the processing of step S347, the CPU 211 causes the tamper 108 to align the plural sheet members Pin the width direction on the plural sheet members P discharged to the stacker tray 106 (step S348). Accordingly, the processing by the execution of the two buffers based on the conveyance processing program is ended.

Figure 11:
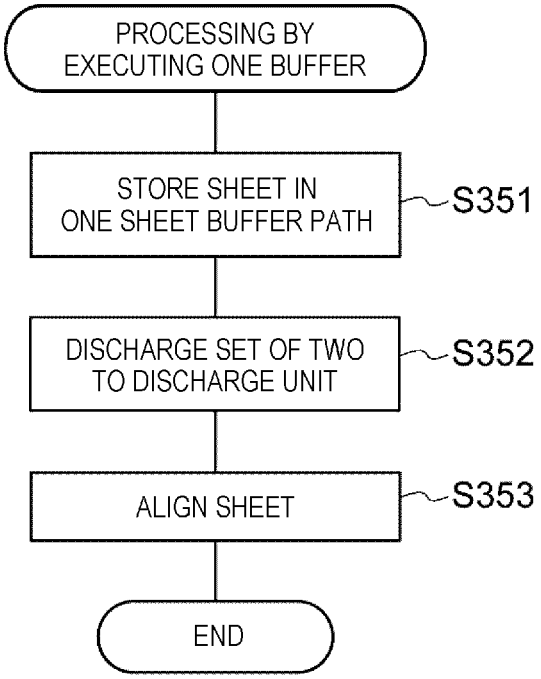
FIG. 11 is a flowchart showing a flow of a second processing performed by the control device according to the first exemplary embodiment when the buffer is implemented.

FIG. 11 is a flowchart showing a flow of a processing performed by the control unit 116 when executing one buffer.

As shown in FIG. 11, when the processing of the one-sheet buffer of the sheet member P is started, the CPU 211 stores the sheet member P in the one-sheet buffer path 104 (step S351). For example, as shown in FIG. 10, one sheet member P (see "sheet member P4" shown in FIG. 10) are temporarily stored in the buffer path 104.

The CPU 211 ejects a set of two sheet members P onto the stacker tray 106 (step S352). For example, two sheet members P including the one sheet member P stored in the buffer path 104 and another sheet member P conveyed after the one sheet member P are stacked together on the compile tray 112, and then a set of two sheet members P is discharged to the stacker tray 106. When the sheet members P are stacked on the compile tray 112, sheet alignment in which the sheet members P are aligned in the width direction may be performed by the tamper 114.

The CPU 211 causes the tamper 108 to align the two sheets P discharged to the stacker tray 106 in the width direction (step S353). Accordingly, the processing by the execution of the one buffer based on the conveyance processing program is ended.

Figure 12:
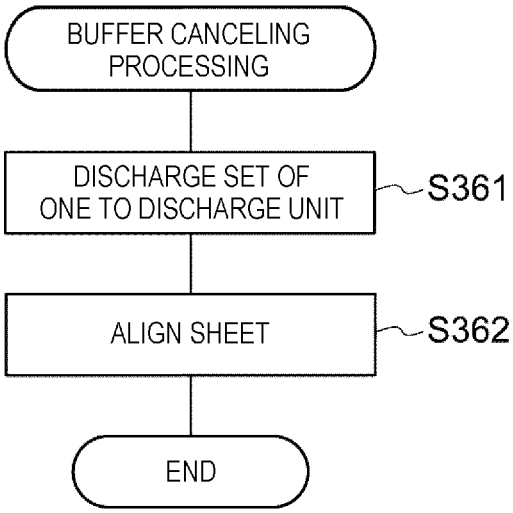
FIG. 12 is a flowchart showing a flow of the third processing performed by the control device according to the first exemplary embodiment when the buffer is implemented.

FIG. 12 is a flowchart showing a flow of buffer cancel processing by the control unit 116.

As shown in FIG. 12, when the buffer canceling processing of the sheet members P is started, the sheet members P are discharged to the stacker tray 106 as a set (step S361). For example, one sheet member P is stored in the buffer path 104, the sheet member P is placed on the compile tray 112, and then the sheet member P is discharged to the stacker tray 106. Instead of this process, one sheet member P may be placed on the compile tray 112 without being stored in the buffer path 104, and then the sheet member P may be discharged to the stacker tray 106.

The CPU 211 causes the tamper 108 to align the one sheet P discharged to the stacker tray 106 in the width direction (step S362). Accordingly, the buffer cancel processing based on the conveyance processing program is ended.

In the above-described buffering processing, the sheet member P on the rear side that cannot be discharged to the stacker tray 106 is temporarily stored in the buffer path 104 while the sheet member P on the front side discharged to the stacker tray 106 is being processed by the tamper 108 or the like without changing the conveyance interval of the sheet member P delivered to the sheet discharge device 100. Then, the sheet member P stored in the buffer path 104 is discharged to the stacker tray 106 together with the rear sheet member P conveyed on the rear side. Therefore, by discharging the plural sheet members P in a set onto the stacker tray 106 and delaying the time for discharging the sheet members P onto the stacker tray 106, it is possible to secure the operation time for sheet alignment of the sheet members P in the width direction by the tamper 108. By delaying the time for the stacker tray 106 to be discharged, it is possible to secure the time for performing the retracting operation of the tamper 108 and an operation of moving the stacker tray 106 in the device depth direction.

In the sheet discharge device 100, the control unit 116 changes the alignment of the sheet members P in the width direction by the tamper 108 provided on the stacker tray 106 depending on whether or not there is storage control for storing the sheet members P in the buffer path 104. Therefore, the sheet discharge device 100 may align the sheet member P while inhibiting a decrease in productivity of the sheet member P, as compared with the case where the sheet alignment method is always the same regardless of whether sheet storage control is performed by the storage unit. Here, the productivity refers to a discharge (processing) amount of the sheet member P per unit time.

In the sheet discharge device 100, the control unit 116 has a first mode in which there is no storage control for storing the sheet member P in the buffer path 104. In the first mode, the control unit 116 discharges one sheet member P to the stacker tray 106, and causes the tamper 108 to align the two sheet members P discharged to the stacker tray 106 once. Therefore, for the sheet discharge device 100, a decrease in the productivity of the sheet member P is inhibited as compared with a case where sheet alignment is performed for each sheet discharged to the discharge unit.

In the sheet discharge device 100, in the first mode, the control unit 116 controls the conveyance unit 102 so as to cause the sheet member P to stand by in the middle of a conveyance path 101 until the sheet member P does not interfere with the rear sheet member P conveyed on the rear side of the sheet member P once per two sheets of the sheet member P conveyed on the conveyance path 101. Therefore, according to the sheet discharge device 100, the decrease in sheet productivity of the sheet member P is inhibited as compared with the case where the sheet conveyance interval is extended without causing the sheet to stand by in the middle of the conveyance path.

In the sheet discharge device 100, the control unit 116 has a second mode in which there is storage control for storing the sheet member P in the buffer path 104. In the second mode, after the sheet member P is stored in the buffer path 104, the control unit 116 discharges the stored sheet member P to the stacker tray 106 together with the rear sheet member P conveyed on the rear side of the sheet member P, and performs sheet alignment in the width direction by the tamper 108 with respect to one discharge. Therefore, according to the sheet discharge device 100, the decrease in the productivity of the sheet member P is inhibited as compared with the case where the sheet conveyance interval is extended without the sheet being stored in the storage unit.

In the sheet discharge device 100, in the second mode, the control unit 116 stores at least two sheet members P in the buffer path 104 in an overlapping manner. Thereafter, the control unit 116 discharges the overlapped sheet members P to the stacker tray 106 together with the rear sheet member P, and performs sheet alignment in the width direction by the tamper 108 with respect to one discharge. Therefore, in the sheet discharge device 100, a decrease in productivity of the sheet member P is inhibited as compared with a case where only one sheet is stored in the storage unit.

In the sheet discharge device 100, in the second mode, after the sheet member P is temporarily accumulated on the compile tray 112, the control unit 116 may discharge the sheet member P from the compile tray 112 to the stacker tray 106. Therefore, in the sheet discharge device 100, the operation time of sheet alignment may be secured by the tamper 108 of the front sheet member P conveyed on the front side of the sheet member P, as compared with a case where the sheet is stored only in the storage unit.

In the sheet discharge device 100, the compile tray 112 is provided with a tamper 114 that aligns the sheet members P stacked on the compile tray 112 in a width direction intersecting the convey direction. Therefore, in the sheet discharging device 100, the sheet members P may be aligned in the width direction by the compile tray 112 before being discharged to the stacker tray 106, as compared with a case where sheet alignment is not performed by the stacking unit.

In the sheet discharge device 100, the control unit 116 executes the first mode when the sheet member P is longer than the length of the A4 size in the lateral direction or when the basis weight of the sheet member P is larger than the predetermined basis weight. Therefore, in the sheet discharge device 100, a decrease in sheet member P productivity is inhibited as compared with a case where a first mode is executed without specifying a sheet type.

The image forming system 10 includes an image forming device main body 20 that forms an image on a sheet member P, and a sheet discharge device 100 to which the sheet member P on which the image has been formed by the image forming device main body 20 is conveyed. Therefore, the image forming system 10 may align the sheet member P while inhibiting a decrease in productivity of the sheet member P, as compared with the case where the sheet alignment method is always the same regardless of whether sheet storage control is performed by the storage unit.

In the sheet discharge device 100, the control unit 116 discharges one sheet member P to the stacker tray 106, and causes the tamper 108 to perform the two sheet members P discharged to the stacker tray 106 once. Therefore, in the sheet discharge device 100, compared with a case where sheets are discharged one by one to perform processing one by one, processing of the sheet members P may be performed, that is, sheet alignment in the width direction of the sheet members P while inhibiting a decrease in productivity of the sheet members P. Here, the productivity refers to a discharge (processing) amount of the sheet member P per unit time.

In the sheet discharge device 100, the control unit 116 has a first mode in which sheet alignment is performed by the tamper 108 without retracting the sheet member P from the conveyance path 101 to the buffer path 104. When in the first mode, the conveyance unit 102 is controlled so as to cause the sheet member P to stand by in the middle of a conveyance path 101 until the sheet member P does not interfere with the rear sheet member P conveyed on the rear side of the sheet member P conveyed on the conveyance path 101. Therefore, according to the sheet discharge device 100, the decrease in sheet productivity of the sheet member P is inhibited as compared with the case where the sheet conveyance interval is extended without causing the sheet to stand by in the middle of the conveyance path.

In the sheet discharge device 100, the control unit 116 causes one time per two or more sheets of the sheet member P conveyed along the conveyance path 101, to stand by in the middle of the conveyance path 101 to such an extent that the sheet member P does not interfere with the sheet member P (see "rear sheet member P2" in FIG. 7) conveyed on the rear side of the sheet member P conveyed on the conveyance path 101. Therefore, according to the sheet discharge device 100, the decrease in sheet productivity of the P is inhibited as compared with the case where stand by is performed each time in the middle of the conveyance path.

In the sheet discharge device 100, the control unit 116 causes the an odd-numbered sheet member P in the number of conveyed sheets, one time per two sheets of the sheet member P conveyed along the conveyance path 101, to stand by in the middle of the conveyance path 101 to such an extent that the sheet member P does not interfere with the sheet member P (see "rear sheet member P2" in FIG. 7) conveyed on the rear side of the sheet member P conveyed on the conveyance path 101. Therefore, in the sheet discharge device 100, a control of causing the sheet member P to stand by in the middle of the conveyance path 101 is simple as compared with a case where the sheet is caused to stand by once every two sheets in a random order.

In the sheet discharge device 100, the processing unit that processes the sheet member P includes the tamper 108 that aligns the sheet member P discharged to the stacker tray 106 in the width direction intersecting the convey direction. Therefore, in the sheet discharge device 100, the sheet members P may be aligned while inhibiting a decrease in productivity of the sheet members P as compared with a case where sheets are discharged one by one and aligned one by one.

The image forming system 10 includes an image forming device main body 20 that forms an image on a sheet member P, and a sheet discharge device 100 to which the sheet member P on which the image has been formed by the image forming device main body 20 is conveyed. Therefore, in the image forming system 10, the sheet member P may be processed while inhibiting a decrease in productivity of the sheet member P as compared with the case where sheets are discharged one by one and processed one by one.

The sheet discharge method includes a step of conveying the sheet member P along the conveyance path 101, a step, which has a first mode of processing the sheet member P, of causing the sheet member P to stand by in the middle of a conveyance path 101 until the sheet member P (refer to rear sheet member P2 shown in FIG. 7) does not interfere with the rear sheet conveyed on the rear side of the sheet member P conveyed on the conveyance path 101; a step of discharging the sheet member P conveyed along the conveyance path 101 one by one sequentially to a stacker tray 106; and a step of executing one processing on two sheets discharged to the stacker tray 106 by the tamper 108. Therefore, in the sheet discharge method, the sheet member P may be processed while inhibiting a decrease in productivity of the sheet member P as compared with the case where sheets are discharged one by one and processed one by one.

Second Exemplary Embodiment

Next, a sheet discharge device 400 according to the second exemplary embodiment is shown. The same components as those of the first and second exemplary embodiments described above are denoted by the same reference numerals, and description thereof is omitted.

Figure 13:
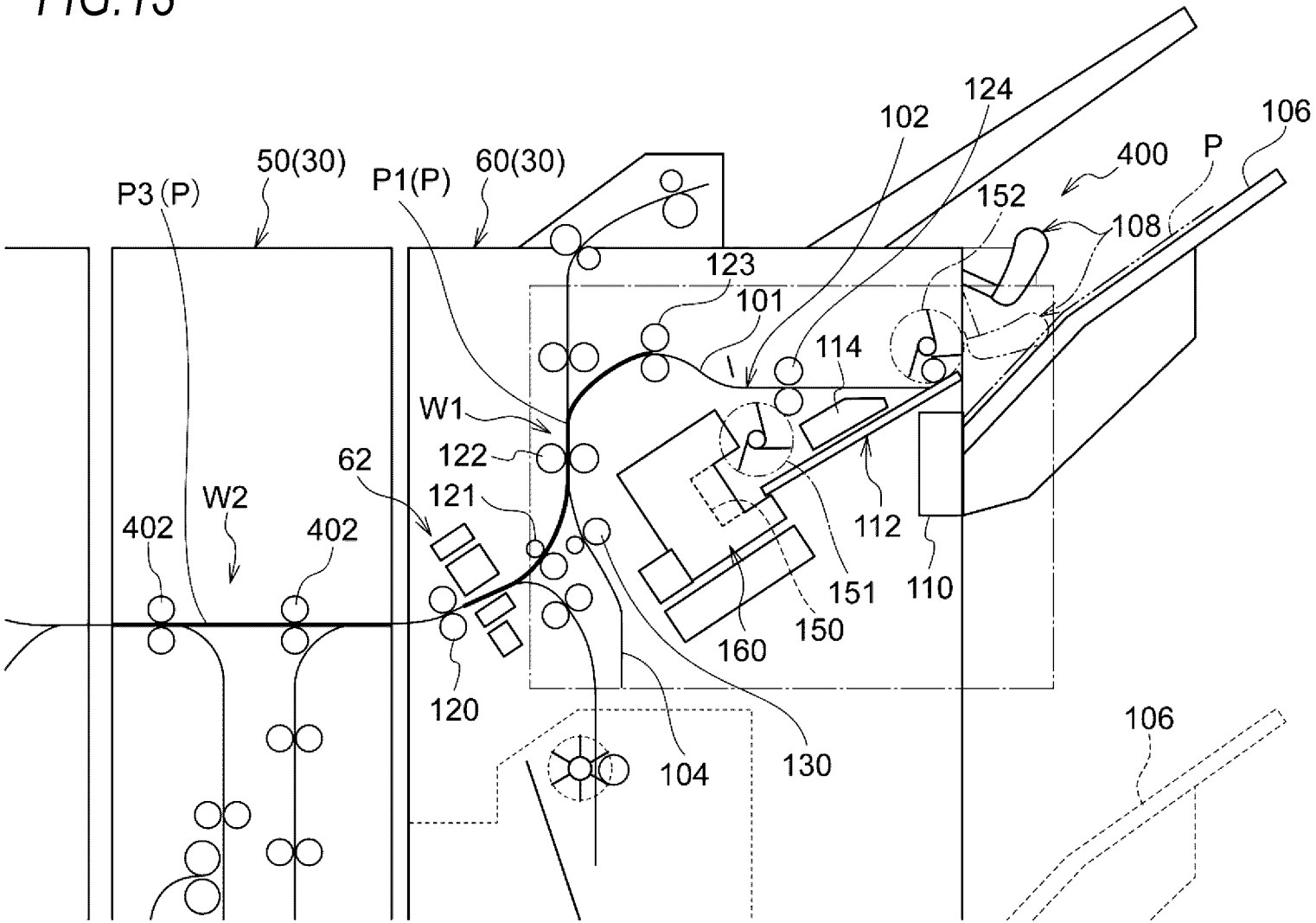
FIG. 13 is a configuration diagram showing a state in which two sheet members are on standby in the image forming system including the sheet discharge device according to the second exemplary embodiment.

As shown in FIG. 13, in the image forming system 10 including the sheet discharge device 400, in the first mode in which there is no storage control for storing the sheet members P in the buffer path 104, the two sheet members P are made to stand by at different positions. As an example, similarly to the first exemplary embodiment, the sheet member P1 is caused to stand by at the standby position W1, and the sheet member P3 conveyed on the rear side of the sheet member P1 is caused to stand by at the standby position W2. As an example, the standby position W2 is provided in the second unit 50. The control unit 116 causes the sheet member P3 to stand by at the standby position W2 by stopping the plural conveyance rollers 402 provided in the second unit 50. Other configurations of the image forming system 10 including the sheet discharge device 400 are similar as those according to the first exemplary embodiment.

The image forming system 10 including the sheet discharge device 400 described above has the following operation and effect in addition to the operation and effect of similar configuration as the image forming system 10 including the sheet discharge device 100 of the first exemplary embodiment.

In the image forming system 10 including the sheet discharge device 400, the two sheet members P are caused to stand by at different standby positions W1 and W2. Therefore, the configuration of a conveyance unit 102 that causes two or more sheet members P to stand by is simplified as compared with a case where two or more sheets are caused to stand by at the same position in the conveyance path. Further, the operation time of sheet alignment may be secured by the tamper 108 of the front side conveyed on the front sheet member P, as compared with a case where one sheet member P is made to stand by.

Modification

Next, the sheet discharge device 100 according to the modification will be described. In the first and second exemplary embodiments, although the processing by the buffer non-execution is executed when the sheet member P is not of a size or basis weight that may be stored in the buffer path 104, in the sheet discharge device 100 according to the modification, the control unit 116 executes the first mode when the moving unit 110 operates. That is, even when the sheet member P is not a sheet member P of a size or basis weight that may be stored in the buffer path 104 (in the case of a sheet member P that cannot be stored in the buffer path 104), the processing of not performing the buffer (that is, the first mode) is executed when the operation of moving the stacker tray 106 in the device depth direction is performed by the moving unit 110.

When the stacker tray 106 is moved in the device depth direction, the tamper 108 needs to be retracted upward by the retraction portion 148 so as not to interfere with the sheet members P stacked on the stacker tray 106, and after the stacker tray 106 is moved in the device depth direction, the tamper 108 needs to be moved to an original position below the stacker tray 106. Therefore, by executing the processing (that is, the first mode) in which the buffer is not executed and causing the sheet member P to stand by in the middle of the conveyance path 101 (the standby position W1 or the like), it is possible to secure the operation time of the movement of the stacker tray 106 and the rotation of the tamper 108. Therefore, in the sheet discharge device 100, a time for moving the stacker tray 106 may be secured while maintaining the productivity of the sheet members P when compared with a case where the sheet is not caused to stand by in the middle of the conveyance path during the operation of a moving unit.

OTHERS

In the first and second exemplary embodiments, the condition of the sheet member P to be stored in the buffer path 104 and to be a target of the storage control may be changed.

In the first and second exemplary embodiments, although in the first mode, when the even-numbered sheet members P are discharged to the stacker tray 106, the sheet alignment is executed by the tamper 108, the present disclosure is not limited to the configuration. For example, when an odd-numbered sheet member P is discharged to the stacker tray 106, the sheet alignment by the tamper 108 may be executed.

In the first exemplary embodiment, although one or two sheet members P are made to stand by in the middle of the conveyance path 101, three or more sheet members P may be made to stand by in the middle of the conveyance path 101.

In the first and second exemplary embodiments, although the tamper 108 that aligns the sheet member P in the width direction is provided as an example of a processing unit that performs processing on the sheet member P, the present disclosure is not limited to this configuration. For example, the processing unit may be configured to perform processing by a staple mechanism unit that binds a bundle of plural sheet members P (that is, stapling processing), punching processing of the sheet members P, and the like.

In the first and second exemplary embodiments, the configuration of the buffer path 104, the configuration of the compile tray 112, the arrangement of the plural conveyance rollers of the conveyance unit 102, the shape of the conveyance path 101, and the like may be changed without departing from the gist of the present disclosure.

In each of the above exemplary embodiments, as a hardware structure of a processing unit that executes various processing such as the control unit 116, various processors described below may be used. As described above, software is executed to serve as various processing units, examples of the various processors include a programmable logic device (PLD) whose circuit configuration may be changed after manufacture of a field programmable gate array (FPGA) or the like, a dedicated electric circuit being a processor having a circuit configuration designed exclusively to execute specific processing such as an application specific integrated circuit (ASIC), and the like.

One processing unit may be configured by one of these various processors, or may be configured by a combination of two or more processors of the same type or different types (for example, a combination of plural FPGAs and/or a combination of a CPU and an FPGA). Plural processing units may be configured by one processor.

As an example in which plural processing units are configured by one processor, there is a configuration in which one processor is configured by a combination of one or more CPUs and software, and the processor functions as plural processing units. Second, as represented by a system on chip (SoC) or the like, there is a form in which a processor that achieves the function of the entire system including plural processing units by one integrated circuit (IC) chip is used. As described above, the various processing units are configured using one or more of the various processors as a hardware structure.

Further, more specifically, the hardware structures of the various processors may use electric circuits (circuitry) in which circuit elements such as semiconductor elements are combined.

Although the embodiments of the present disclosure have been described above, it is needless to say that the present disclosure is not limited to the above embodiments, and may be implemented in various forms without departing from the gist of the present disclosure.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet discharge device, comprising:

at least one processor;

a conveyance unit configured to convey a sheet along a conveyance path;

a discharge unit to which the sheet is discharged;

a storage unit that is provided in a middle of the conveyance path and temporarily stores the sheet;

an alignment unit provided in the discharge unit and configured to align the sheet in a width direction intersecting a convey direction of the sheet, wherein the processor is configured to change a method of aligning the sheets by the alignment unit between a case where storage control for storing the sheets in the storage unit is performed and a case where the storage control is not performed.

2. The sheet discharge device according to claim 1, wherein the processor is configured to execute a first mode in which the storage control of the sheet is not performed, and in the first mode, the processor is configured to discharge the sheets one by one to the discharge unit and perform one sheet alignment on two sheets discharged to the discharge unit by the alignment unit.

3. The sheet discharge device according to claim 2, wherein in the first mode, the processor is configured to control the conveyance unit to cause the sheet to stand by in the middle of the conveyance path until the sheet does not interfere with a rear sheet conveyed on the rear side of the sheet once per two sheets conveyed on the conveyance path.

4. The sheet discharge device according to claim 1, wherein the processor is configured to execute (i) a first mode in which the storage control of the sheet is not performed, and (ii) a second mode in which the storage control of the sheet is performed, and in the second mode, after the sheet is stored in the storage unit, the stored sheet is discharged to the discharge unit together with a rear sheet conveyed on a rear side of the sheet, and sheet alignment is executed by an alignment portion with respect to one discharge of the stored sheet and the rear sheet.

5. The sheet discharge device according to claim 2, wherein the processor is configured to execute a second mode in which the storage control of the sheet is performed, and in the second mode, after the sheet is stored in the storage unit, the stored sheet is discharged to the discharge unit together with a rear sheet conveyed on a rear side of the sheet, and sheet alignment is executed by an alignment portion with respect to one discharge of the two sheets.

6. The sheet discharge device according to claim 3, wherein the processor is configured to execute a second mode in which the storage control of the sheet is performed, and in the second mode, after the sheet is stored in the storage unit, the stored sheet is discharged to the discharge unit together with a rear sheet conveyed on a rear side of the sheet, and sheet alignment is executed by an alignment portion with respect to one discharge of the two sheets.

7. The sheet discharge device according to claim 4, wherein in the second mode, the processor is configured to:

store at least two sheets in the storage unit in a stacked manner;

discharge the stacked sheets to the discharge unit together with the rear sheet conveyed after the stacked sheets, and perform sheet alignment with respect to one discharge of the sheets by the alignment unit.

8. The sheet discharge device according to claim 7, further comprising a stacking unit that temporarily stacks the sheets in the middle of the conveyance path, wherein in the second mode, the processor is configured to discharge the sheet from the stacking unit to the discharge unit after placing the sheet on the stacking unit.

9. The sheet discharge device according to claim 8, wherein the stacking unit further comprises another alignment unit configured to align the sheets placed on the stacking unit in a width direction intersecting the convey direction.

10. The sheet discharge device according to claim 2, wherein the processor is configured to execute the first mode when the sheet is longer than a short side of the A4 size or when a basis weight of the sheet is larger than a predetermined basis weight.

11. An image forming device, comprising:

an image forming unit configured to form an image on a sheet; and the sheet discharge device according to claim 1 in which the sheet on which the image is formed by the image forming unit is conveyed.

12. A sheet discharge device, comprising:

at least one processor;

a conveyance unit configured to convey a sheet along a conveyance path;

a discharge unit to which the sheet is discharged; and a processing unit provided in the discharge unit and configured to perform processing on the sheet, wherein the processor is configured to discharge the sheets one by one to the discharge unit and execute one processing on two or more sheets discharged to the discharge unit by the processing unit, and wherein the processor causes an odd-numbered or even-numbered sheet in a number of conveyed sheets to stand by in a middle of the conveyance path until the sheet does not interfere with a rear sheet conveyed after the odd-numbered or even-numbered sheet once per two sheets conveyed on the conveyance path.

13. The sheet discharge device according to claim 12, wherein the processor is configured to execute a mode of processing the sheet by the processing unit without retracting the sheet from the conveyance path, and control the conveyance unit to cause the sheet to stand by in a middle of the conveyance path until the sheet does not interfere with a rear sheet conveyed on the rear side of the sheet on the conveyance path.

14. The sheet discharge device according to claim 13, comprising:

a moving unit configured to move the discharge unit in a width direction intersecting a conveyance direction of the sheet, wherein the processor is configured to execute the mode during operation of the moving unit, and cause the sheet to stand by in the middle of the conveyance path to such an extent that the sheet does not interfere with the rear sheet.

15. The sheet discharge device according to claim 12, wherein the processor is configured to cause the sheet to stand by in the middle of the conveyance path until the sheet does not interfere with the rear sheet conveyed on the rear side of the sheet once per two or more sheets conveyed on the conveyance path.

16. The sheet discharge device according to claim 15, wherein the processor is configured to cause two or more sheets to stand by at different positions in the middle of the conveyance path.

17. The sheet discharge device according to claim 12, wherein the processing unit comprises an alignment unit configured to align the sheets discharged to the discharge unit in a width direction intersecting a conveyance direction.

18. An image forming device, comprising:

an image forming unit configured to form an image on a sheet; and the sheet discharge device according to claim 12 in which the sheet on which the image is formed by the image forming unit is conveyed.

19. A sheet discharge device, comprising:

at least one processor;

a conveyance unit configured to convey a sheet along a conveyance path;

a discharge unit to which the sheet is discharged; and a processing unit provided in the discharge unit and configured to perform processing on the sheet, wherein the processor is configured to discharge the sheets one by one to the discharge unit and execute one processing on two or more sheets discharged to the discharge unit by the processing unit, the processor is configured to cause the sheet to stand by in a middle of the conveyance path until the sheet does not interfere with a rear sheet conveyed on the rear side of the sheet once per two or more sheets conveyed on the conveyance path, and the processor is configured to cause two or more sheets to stand by at different positions in the middle of the conveyance path.

20. An image forming device, comprising:

an image forming unit configured to form an image on a sheet; and the sheet discharge device according to claim 19 in which the sheet on which the image is formed by the image forming unit is conveyed.

* * * * *